US012478203B1

(12) United States Patent
Roesch

(10) Patent No.: US 12,478,203 B1
(45) Date of Patent: Nov. 25, 2025

(54) MECHANICAL ASSEMBLY TO TIE LACES

(71) Applicant: Jeremy Roesch, Star, ID (US)

(72) Inventor: Jeremy Roesch, Star, ID (US)

( * ) Notice: Subject to any disclaimer, the term of this patent is extended or adjusted under 35 U.S.C. 154(b) by 0 days.

(21) Appl. No.: 18/921,562

(22) Filed: Oct. 21, 2024

Related U.S. Application Data

(63) Continuation-in-part of application No. 18/131,291, filed on Apr. 5, 2023, now abandoned.

(60) Provisional application No. 63/328,174, filed on Apr. 6, 2022.

(51) Int. Cl.
*A47G 25/88* (2006.01)
*B65H 69/04* (2006.01)

(52) U.S. Cl.
CPC ..... *A47G 25/88* (2013.01); *B65H 69/04* (2013.01)

(58) Field of Classification Search
CPC ..... A47G 25/80; A47G 25/88; B65H 69/04; D04G 5/00
USPC ..... 289/2, 13, 17
See application file for complete search history.

(56) References Cited

U.S. PATENT DOCUMENTS 7,841,631 B2 * 11/2010 Holmes ..... D04G 5/00 289/2
2011/0233930 A1 * 9/2011 Borrowman ..... B65B 51/08 289/2

FOREIGN PATENT DOCUMENTS

CN 111407137 A * 7/2020 ..... A47G 25/88

OTHER PUBLICATIONS

Translation CN 111407137.*

* cited by examiner

*Primary Examiner* — Shaun R Hurley
(74) *Attorney, Agent, or Firm* — Burdick Patents, P.A.; Sean D. Burdick; Colin L. Honan

(57) ABSTRACT

A mechanical assembly has an inner body with a slider assembly comprised of a left slider arm and a right slider arm. A left wing is joined to the inner body with a left hinge. A right wing is joined to the inner body with a right hinge. Interlocking gears join the left wing to the right wing. A left tweezer is joined to the left wing. A right tweezer is joined to the right wing. A left end of a shoelace is arranged through the left slider assembly arm. A right end of the shoelace is arranged through the right slider assembly arm. Closing the left wing and the right wing together will grab the left and right ends of the shoelace with the left tweezer and the right tweezer, respectively, and opening the left wing and the right wing together will tie the ends into a bow.

3 Claims, 7 Drawing Sheets

MECHANICAL ASSEMBLY TO TIE LACES

RELATED APPLICATION

This application is a continuation-in-part of non-provisional patent application U.S. Ser. No. 18/131,291 filed on Apr. 5, 2023. "the '291 Application"

The '291 Application claims priority to provisional patent application U.S. Ser. No. 63/328,174 filed on Apr. 6, 2022 "the '174 Application"

The entire contents of the '291 Application and the '174 Application are herein incorporated by reference.

BACKGROUND

The embodiments herein relate generally to hand tools.

Prior to embodiments of the disclosed invention, human users had difficulty tying laces. Embodiments of the disclosed invention solve this problem.

SUMMARY

A mechanical assembly is configured to tie laces into a bow. The mechanical assembly has an inner body with a slider assembly comprised of a left slider arm and a right slider arm. A left wing is joined to the inner body with a left hinge. A right wing is joined to the inner body with a right hinge. Interlocking gears join the left wing to the right wing. A left tweezer is joined to the left wing. A right tweezer is joined to the right wing. A left button controls the left tweezer. A right button controls the right tweezer. A left end of a shoelace is arranged through the left slider assembly arm. A right end of the shoelace is arranged through the right slider assembly arm. Closing the left wing and the right wing together will grab the left end and the right end with the left tweezer and the right tweezer when the left button and right button are pressed. Opening the left wing and the right wing together will tie the left end and the right end into a bow.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
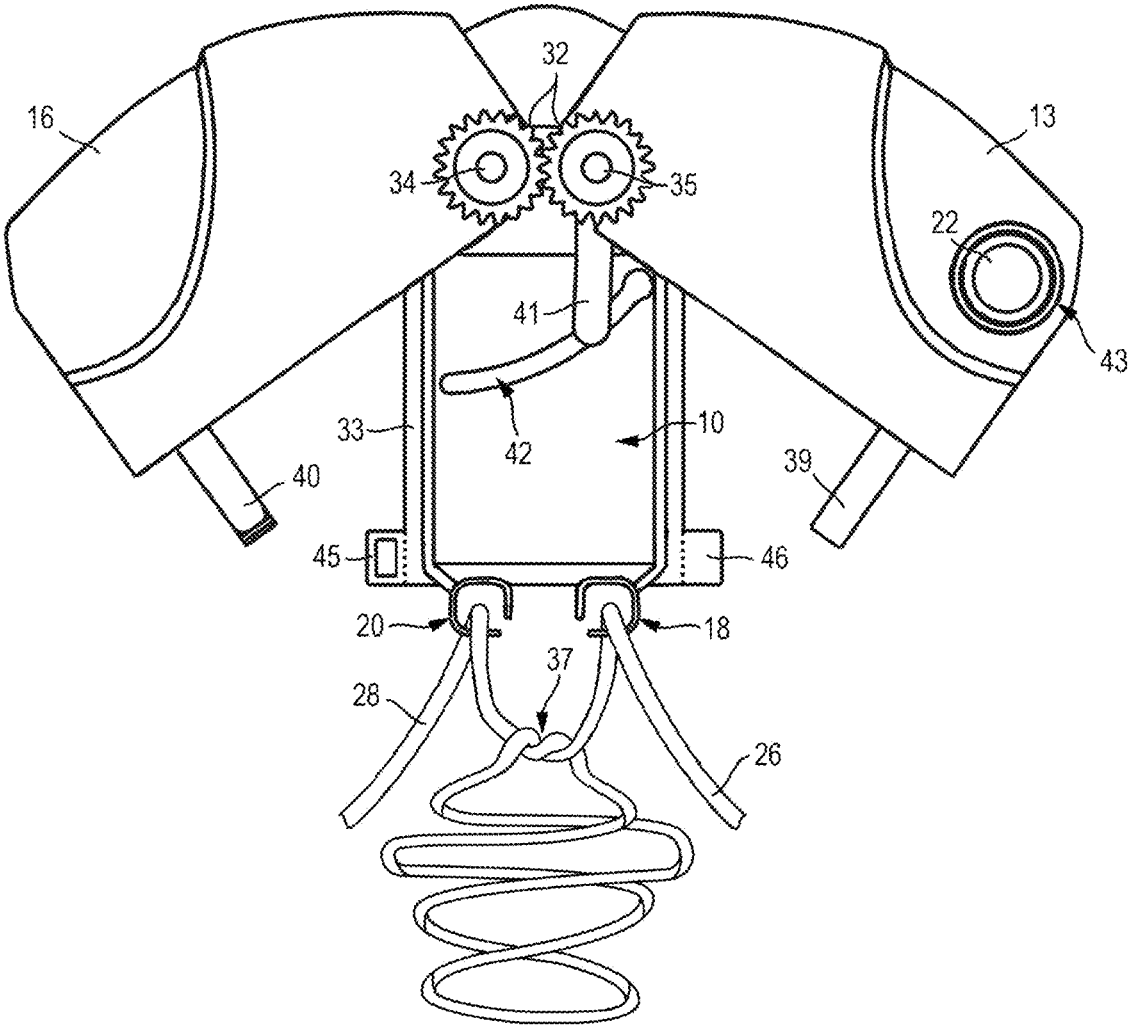
FIG. 1 shows a front view of one embodiment of the present invention in an open position.

By way of example, and referring to FIGS. 1-7, one embodiment of a mechanical assembly is configured to tie shoelaces. The mechanical assembly comprises an inner body 33 containing a slider assembly 10 comprised of a left slider arm 20 and a right slider arm 18. The right slider arm 20 and the left slider arm 18 extend outward from the inner body 33.

A left wing 16 is joined to the inner body 33 with a left hinge 34. A right wing 13 is joined to the inner body 33 with a right hinge 35. The left hinge 34 and the right hinge 35 are joined to interlocking gear 32 so that the left wing 16 and the right wing 13 move in unison.

Figure 2:
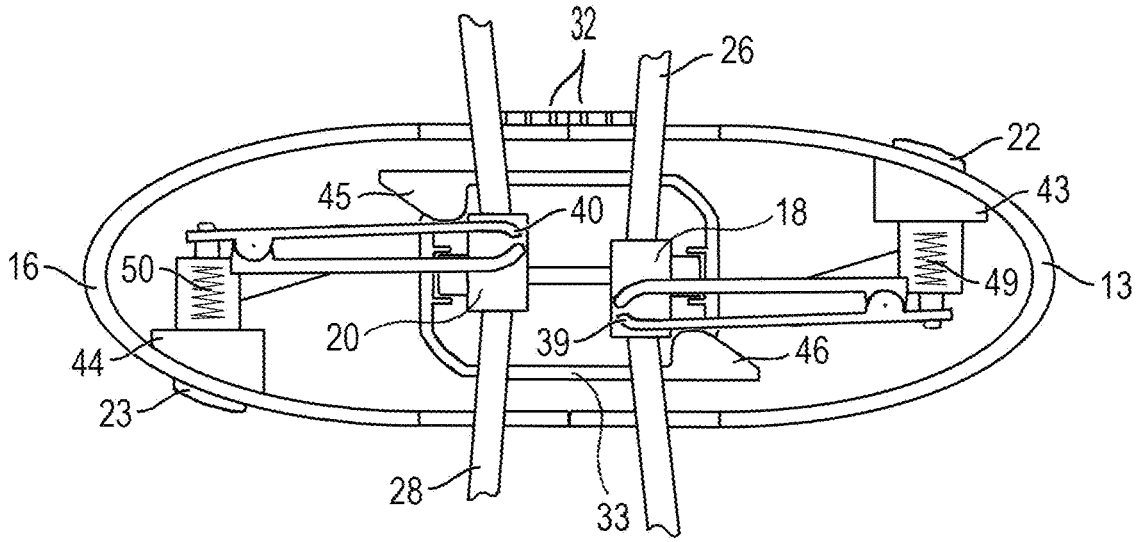
FIG. 2 shows a bottom view of one embodiment of the present invention in a wings closing configuration.
Figure 3:
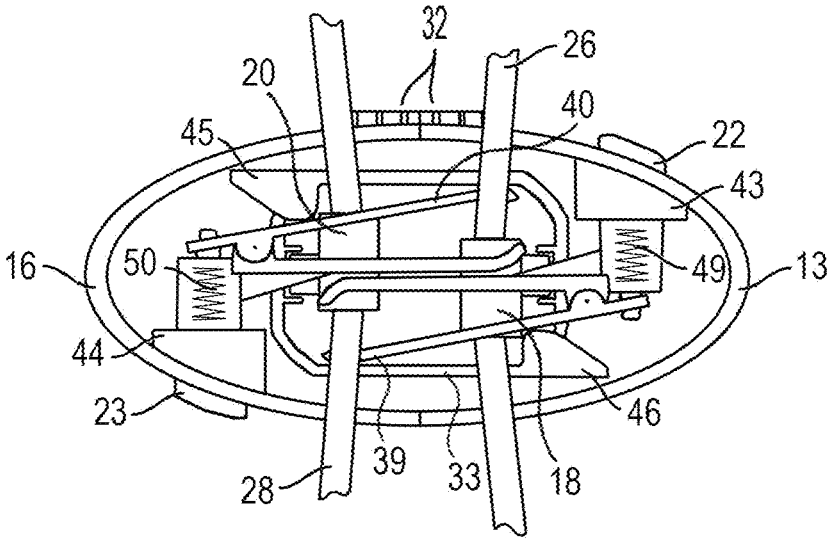
FIG. 3 shows a bottom view of one embodiment of the present invention in a wings closed position.

A left tweezer 40 is joined to the left wing 16 via the left button assembly FIG. 2: 44. A right tweezer 39 is joined to the right wing 13 via the right button assembly FIG. 2: 43.

The inner body 33 is joined to a slider assembly 10. The inner body 33 further comprises a left ramp 45 and a right ramp 46. A lever arm 41 is joined to the right wing 13 joined at the right hinge 35. The lever arm 41 travels in the cutout 42 of the slider assembly 10.

To prepare the device for use one can start the device in the open-wing state as shown in FIG. 1. The user can start the shoelace with a single knot 37. The user can hold the device one inch above the single knot 37 in an upright position.

Next, the user can insert the left end 28 of the shoelace through the front opening of the left slider arm 20 of the slider assembly 10. The user can then pull the left end 28 of the lace through the left slider arm 20 towards the back of the device all the way leaving one inch of slack between the bottom of the device and the single knot 37.

The user can then insert the right end 26 of the shoelace through the back opening of the right slider arm 18 of the slider assembly 10. One can pull the right end 26 of the lace through the right slider arm 18 towards the front of the device all the way leaving one inch of slack between the bottom of the device and the single knot 37.

Following that, with the device standing upright, one can slowly start to close the wings 13, 16. The wings 13, 16 rotate in tandem on interlocking gears 32. As the wings start to close the left and right tweezers 40, 39 remain in an open state with the help of springs FIG. 2: 50, 49 housed in the button assemblies 44, 43 attached to each wing 16, 13. As the wings close the slider assembly FIG. 1: 10 will rise up towards the top of the device due to a slider lever arm 41 and slider arch cutout 42 of the slider assembly 10. As the slider assembly 10 rises upward it brings with it the left and right ends 28, 26 of the inserted shoelace positioned between two small ramps 45, 46 on the left and right side of the inner body 33.

As the left and right tweezers FIG. 2: 40, 39 come in contact with the small ramps 45, 46 they force the tweezers to close just enough to enter the inner body 33. The closed tweezers 40, 39 pass under the rising slider arms 20, 18 holding the left and right ends 28, 26 of the shoelace. As the wings FIG. 3: 16, 13 continue to close the left and right tweezers 40, 39 open again with the help of a spring in the button assembly 44, 43 as the ramps 45, 46 are cleared. The tweezers pass under the rising slider arms 20, 18 that the left and right shoelace ends 28, 26 were inserted into. When each tweezer 40, 39 approaches the opposite end of the inner body 33 they are fully open again as they slide into position to grab the shoelace end of the opposite side. Right tweezer 39 positioned to grab the left end 28 of the shoelace. Left tweezer 40 positioned to grab the right end 26 of the shoelace.

Figure 4:
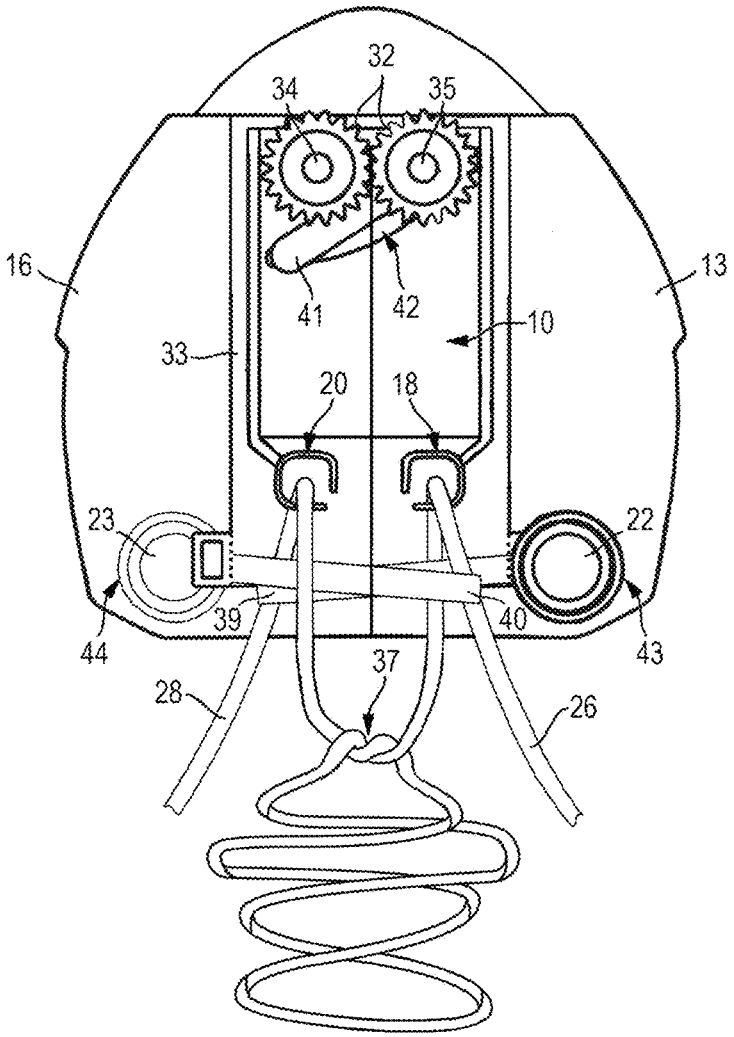
FIG. 4 shows a front view of one embodiment of the present invention in showing internal components.
Figure 5:
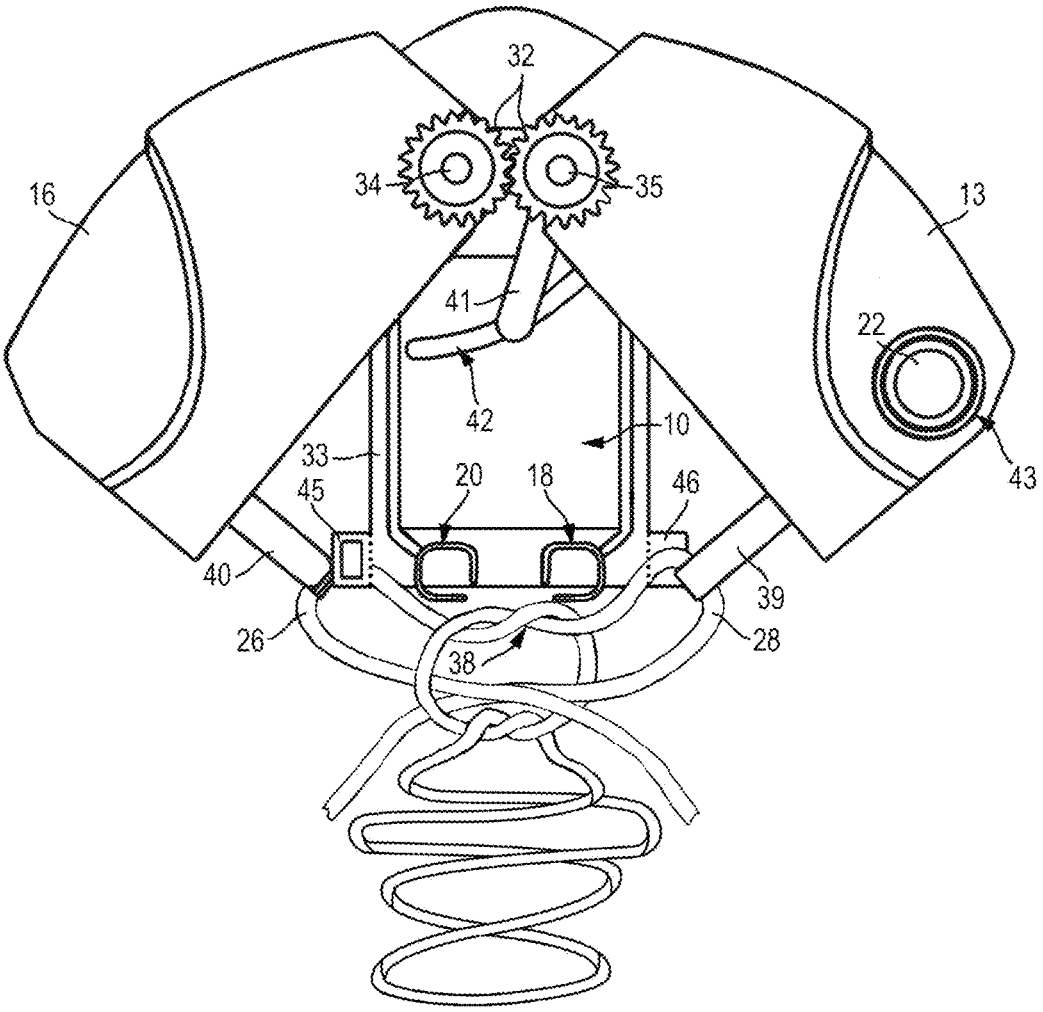
FIG. 5 shows a front view of one embodiment of the present invention in an wings opening configuration.

Once the wings are fully closed, as shown in FIG. 4, the left and right buttons 23, 22 need to be fully depressed to close the tweezers 39, 40. The tweezers close and grab hold of the previously inserted shoelace ends 26, 28.

While holding the left and right buttons 23, 22 in their depressed state, slowly open the wings 16, 13. Doing so will pull the left and right ends FIG. 5: 28, 26 away from their relevant slider arms 20, 18 and under the shoelace end of the opposite side that was previously held by the slider arms 20, 18. The left end 28 was once held by the left slider arm 20 and the right end 26 was once held by the right slider arm 18. As the wings are further extended a tied shoelace or bowknot 38 begins to form.

Figure 6:
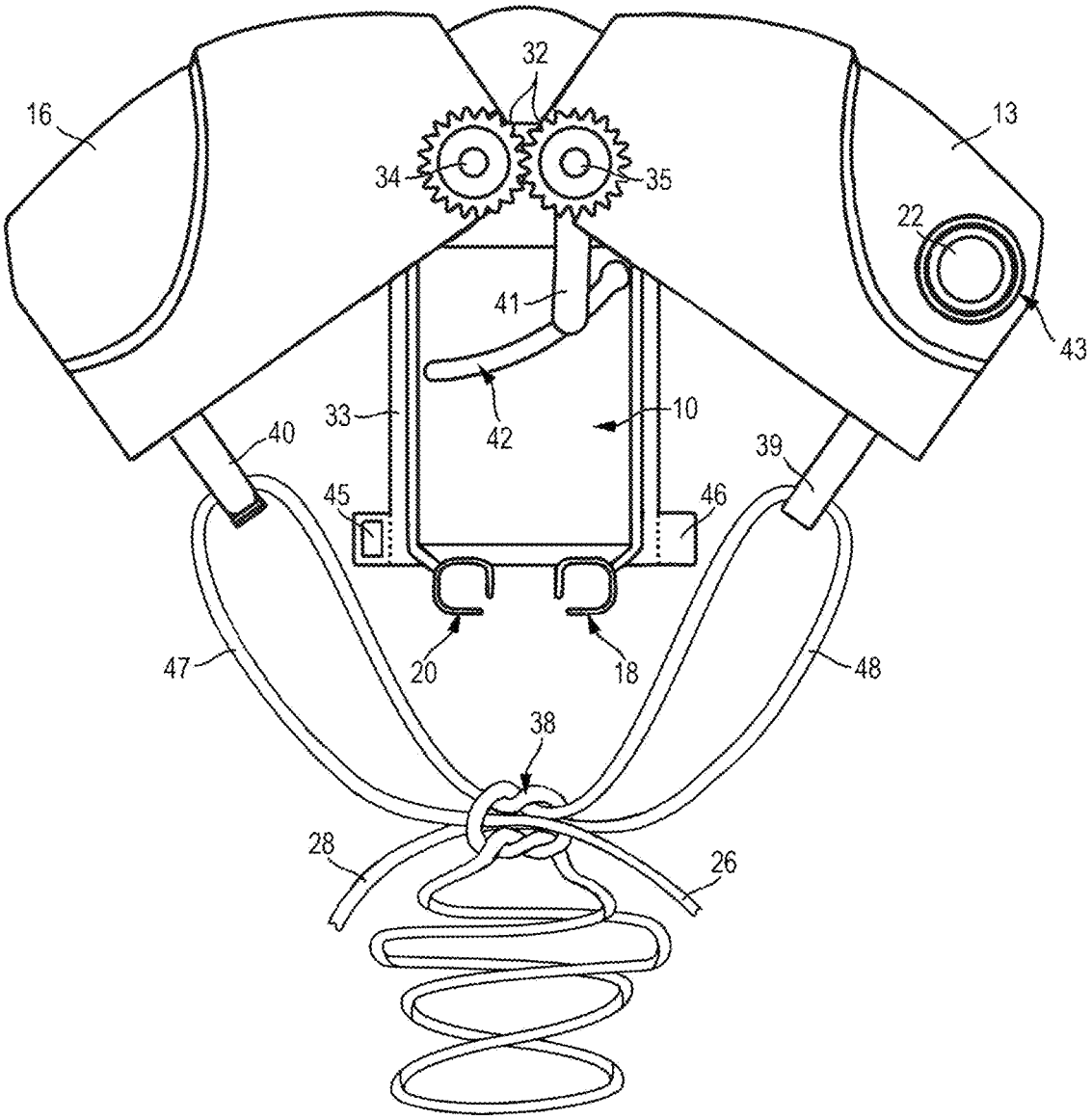
FIG. 6 shows a front view of one embodiment of the present invention in an open configuration.

As shown in FIG. 6, one can release the buttons 23, 22 once the wings 16, 13 are fully extended to allow the left and right tweezers 40, 39 to release the left and right bows 47, 48. A fully tied bowknot is produced 38.

Figure 7:
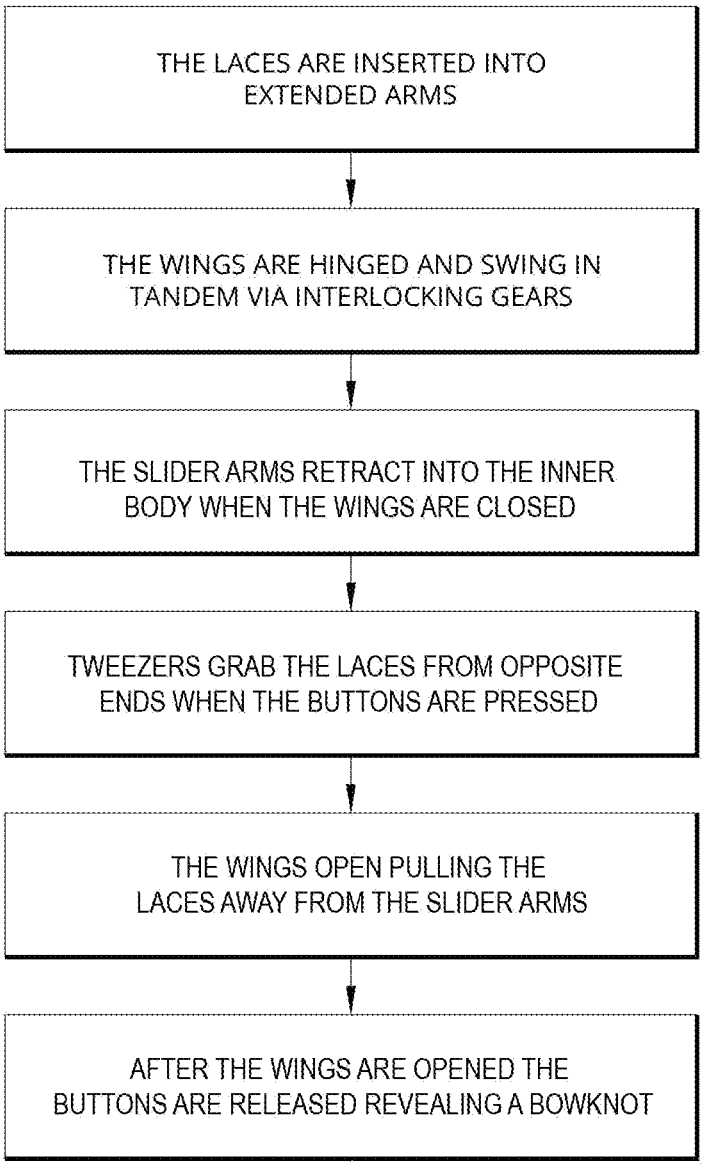
FIG. 7 shows a flow chart describing a use of one embodiment of the present invention.

FIG. 7 shows a process for using the mechanical assembly. First, the ends of the lace are inserted into the extended slider arms 18, 20 with the wings in the open state. The wings 13, 16 are hinged 34, 35 and swing in tandem via interlocking gears 32. After that, the slider arms 18, 20 retract into the device inner body 33 when the wings are closed 13, 16. The tweezers 39, 40 grab the shoelace ends 28, 26 from opposite ends when the buttons are pressed. Then the wings open pulling the lace ends 28, 26 away from their extended slider arms 20, 18. After the wings are opened and buttons 22, 23 are released a bowknot is revealed.

As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application for example, a reference that is partially inconsistent is incorporated by reference except for the partially inconsistent portion of the reference.

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. § 112, ¶6. In particular, any use of "step of" in the claims is not intended to invoke the provision of 35 U.S.C. § 112, ¶6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A mechanical assembly, configured to tie a shoelace into a bow from a single knot, the shoelace having a left end and a right end; the mechanical assembly comprising:

an inner body further comprising a left slider arm configured to receive the left end of the shoelace and a right slider arm configured to receive the right end of the shoelace;

a left wing, joined to the inner body with a left hinge;

a right wing, joined to the inner body with a right hinge;

interlocking gears, joining the left wing to the right wing;

a left tweezer, joined to the left wing;

a right tweezer, joined to the right wing;

a left button controls the left tweezer;

a right button controls the right tweezer;

wherein, when the left end of the shoelace is engaged with the left slider arm and the right end of the shoelace is engaged with the right slider arm, closing the left wing and the right wing together causes the left tweezer to grab the left end of the shoelace and the right tweezer to grab the right end of the shoelace when the left button and right button are pressed; and opening the left wing and the right wing together will tie the left end and the right end into a bow from the single knot.

2. The mechanical assembly of claim 1, wherein the left button is joined to the left wing and is configured to depress the left tweezer.

3. The mechanical assembly of claim 2, wherein the right button is joined to the right wing and is configured to depress the right tweezer.

* * * * *